US009844889B1

(12) United States Patent
Budek et al.

(10) Patent No.: US 9,844,889 B1
(45) Date of Patent: Dec. 19, 2017

(54) ROTARY TOOL EJECTION TECHNOLOGY

(71) Applicant: Weidenmiller Company, Itasca, IL (US)

(72) Inventors: Rich Paul Budek, Elmhurst, IL (US); Stephen J. Kras, Chicago, IL (US)

(73) Assignee: Weidenmiller Company, Itasca, IL (US)

( * ) Notice: Subject to any disclaimer, the term of this patent is extended or adjusted under 35 U.S.C. 154(b) by 0 days.

(21) Appl. No.: 15/262,299

(22) Filed: Sep. 12, 2016

Related U.S. Application Data

(60) Provisional application No. 62/218,135, filed on Sep. 14, 2015.

(51) Int. Cl.
*B26D 7/18* (2006.01)
*B21B 27/02* (2006.01)
*B26D 7/26* (2006.01)

(52) U.S. Cl.
CPC ..... *B26D 7/18* (2013.01); *B21B 27/02* (2013.01); *B26D 7/2614* (2013.01); *B26D 2007/2607* (2013.01)

(58) Field of Classification Search
CPC ..... B26D 7/18; B26D 7/2614; B26D 2007/2607; B21B 27/02
See application file for complete search history.

(56) References Cited

U.S. PATENT DOCUMENTS 4,276,800 A * 7/1981 Koppa ..... A21C 11/04 425/289
4,282,810 A * 8/1981 Ellis ..... B41F 13/10 101/153
4,737,092 A * 4/1988 Bullick ..... A21C 11/16 425/142
5,162,119 A * 11/1992 Pappas ..... A21C 9/04 101/106
5,306,133 A * 4/1994 Dayley ..... A21C 11/04 264/155
7,914,834 B2 * 3/2011 Fu ..... A21C 11/04 425/299
8,622,729 B2 * 1/2014 Suski ..... A21C 11/04 425/235
8,622,730 B2 * 1/2014 Suski ..... A21C 5/003 425/235
2005/0226963 A1 * 10/2005 Addington ..... A21C 11/10 426/104
2005/0226981 A1 * 10/2005 Flook ..... A21C 11/10 426/503

* cited by examiner

*Primary Examiner* — Sean Michalski
(74) *Attorney, Agent, or Firm* — Quarles & Brady LLP

(57) ABSTRACT

A rotary tool ejection technology utilizing air to eject contents from the dies of a rotary cylinder. The dies include orifices positioned therein. The orifices are assembled with porous material. The orifices are capable of receiving air from an internal chamber and delivering it to the outer surface of a rotary cylinder. Air is supplied to the internal chamber by an internal shaft. The internal shaft contains a channel in fluid communication with outlets extending radially outward from the channel to locations on the outer surface of the shaft. The shaft is optionally assembled with a manifold having a conduit. The conduit is positioned for intermittent alignment with the orifices in the rotary cylinder as the rotary cylinder rotates relative to the manifold.

13 Claims, 10 Drawing Sheets

ROTARY TOOL EJECTION TECHNOLOGY

RELATED APPLICATIONS

The present patent document claims the benefit of the filing date under 35 U.S.C. §119(e) of Provisional U.S. Patent Application Ser. No. 62/218,135, filed Sep. 14, 2015, which is hereby incorporated by reference.

BACKGROUND

Consumers increasingly rely upon the convenience of packaged food products. Convenience foods for both animals and humans have proliferated—and range from healthy to indulgent. Consumables such as but not limited to cookies, candies, crackers, and animal nourishment, come in a variety of textures, compositions, shapes, and sizes. Rotary die cutters and rotary die molds are a popular method of forming consumable food products.

BRIEF SUMMARY

A rotary die ejection technology is disclosed. A rotary cylinder includes die cavities and/or die cutters arranged on its surface and assembled with ejection orifices. The ejection orifices are in fluid communication with the internal chamber of the rotary cylinder. The ejection orifice is associated with a porous material.

A shaft having a channel may extend axially through the internal chamber. The shaft may have a channel seated therein. The channel may be in fluid communication with outlets extending generally radially outward form the channel to locations on the outer surface of the shaft. The outlets may eject air directly into the space of the internal chamber. Alternatively or additionally, the shaft may be assembled with a manifold. The manifold may be positioned below the shaft and may include conduits. The conduits may be positioned for intermittent alignment with the orifices in the rotary cylinder as the rotary cylinder rotates relative to the manifold.

Other features and advantages of the disclosure will be, or will become, apparent to one of skill in the art upon examination of the following figures and detailed description. It is intended that all such additional advantages and features be included in the description, be within the scope of the invention, and be protected by the claims.

DETAILED DESCRIPTION OF THE DRAWINGS

Figure 1:
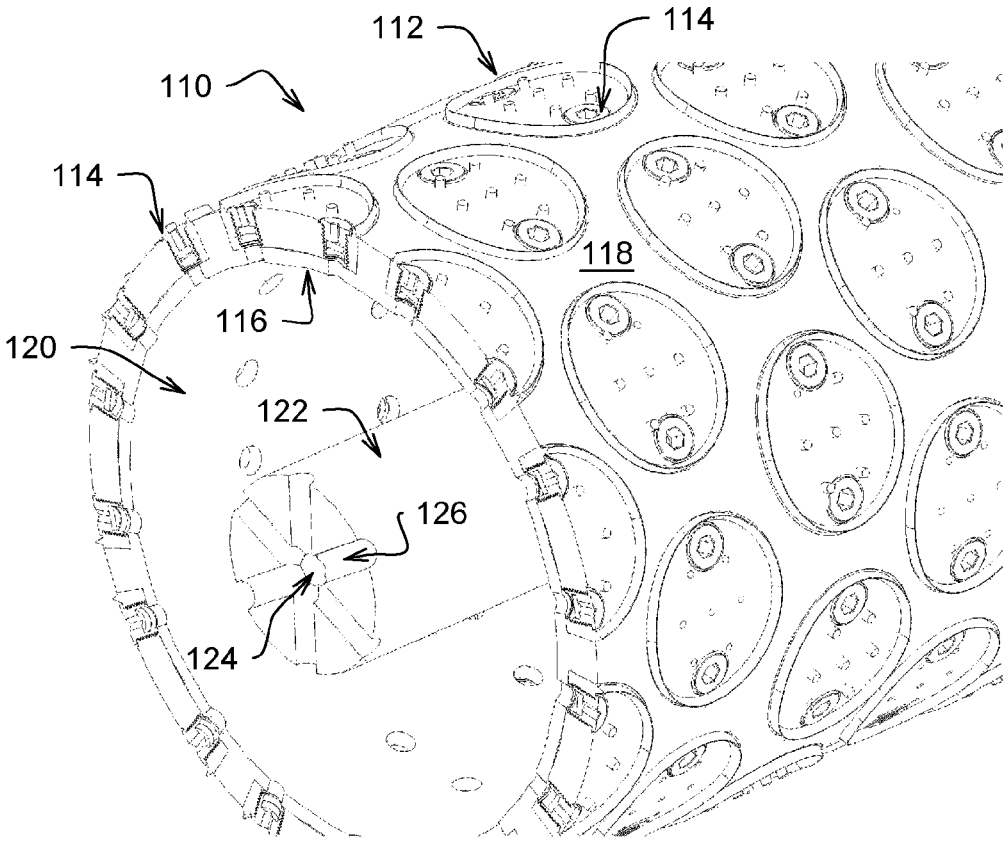
FIG. 1 provides a partial cross section view of a first rotary tool with section normal to the shaft axis.

Food products of various kinds, including cookies, crackers, candies, animal consumables, and other products, are frequently formed by high-volume automated rotary mold and/or rotary cutting devices. A rotary die molder is a cylinder, the surface of which is covered with shallow engraved cavities. A rotary cutter is a cylinder, the surface of which is covered with portions that rise about the face of the cylinder. Hybrid forms may also exist which include both engraved cavities and raised portions. In one exemplary process, the cylinder rotates past the opening in a hopper filled with food product (e.g., a food dough). The food product fills any engraved portions on the cylinder. Excess dough is sheared off from the main mass by a blade. As the cylinder continues to rotate, the dough pieces are released and/or ejected, e.g., onto a conveyor belt. In some variations, there are two counter rotating rolls, e.g., a molding roll and a feed roll. The dough may fill the pinch point created by the two rolls and may be thereby forced into a mold cavity.

In another exemplary process, rotary die cutting uses a cylindrical die on a rotary press. A long sheet or web of material is fed through the rotary press into an area which holds a rotary tool, for example but not limited to, a rotary die cutter or a rotary die mold. The rotary tool may cut out shapes, make perforations or creases, impart aesthetic design, and/or cut the sheet or web into smaller parts. In a variation, rotary die cutting allows for the manufacture of multiple substantially identical formed products. In a variation, a molder may have several different shapes per roll, for example, cookies in the shape of various animals.

Several processes are used to release the formed product from the rotary tool. Some use fat and lard as lubricants to discourage attachment of the food product to the rotary tool. For example, some manufacturers increase the fats and/or oils used in dough recipes to achieve a dough that will have reduced affinity for the rotary tool. However, the addition of fat to foods has become less desirable to consumers who are weight and/or health conscious. With the rising popularity of fat-free products, the industry increasingly adopted rotary tool coatings to assist release of formed shapes. Examples of rotary tool coatings include formulations of TEFLON and ceramics that are FDA and USDA approved for food contact.

Many known coatings wear out from repeated use; therefore the rotary tools require routine maintenance. As the rotary tool coatings wear out, the release fidelity decreases. Product increasingly sticks to the surface of the rotary tool. Decreases in fidelity result in considerable expense due to lost food product (e.g., through deformations, and sticking), down time, and loss of efficiency. Furthermore, the maintenance process results in downtime. Maintenance requires removing the subject machine from operation while the rotary tool is removed for reconditioning. The reconditioning process takes several days to several weeks and bears a significant expense. In an attempt to realize a large product output despite the maintenance inefficiencies, many companies are required to run several machine lines so that they can rotate production and maintenance. This requires larger more expensive facilities to house redundant machinery.

We disclose a rotary tool ejection technology that is capable of operating at high efficiency with minimal maintenance. In one variation, the rotary tool ejection technology eliminates the requirement of rotary tool coatings. In a variation, the rotary tool ejection technology eliminates the requirement of the use of lubricants, including by increasing the fat content of the food product. In a variation, the rotary tool ejection technology features a rotary tool with no internal moving parts, further reducing maintenance concerns. The reduction of moving parts further increases the sanitation of the system, as moving parts often create additional surfaces in which food product may be trapped.

We also disclose a novel method of employing a porous material within the rotary tool system. In one variation, the porous material may be a porous metal material that has inter-connected porosity. A porous metal material may be fabricated from metal powder particles using powder metallurgy techniques. The porous material may have a range of pore sizes from about 0.5 micrometer to about 200 micrometers.

DEFINITIONS

Definitions: unless stated to the contrary, for the purpose of the present disclosure the following terms shall have the following definitions:

A reference to "another variation" in describing an example does not imply that the referenced variation is mutually exclusive with another variation unless expressly specified.

The terms "a," "an" and "the" mean "one or more," unless expressly specified otherwise.

The phrase "at least one of" when modifying a plurality of things (such as an enumerate list of things) means any combination of one or more of those things, unless expressly specified otherwise.

The term "represent" and like terms are not exclusive, unless expressly specified otherwise. For example, the term "represents" does not mean "represents only," unless expressly specified.

The term "e.g." and like terms means "for example, but not limited to" and thus does not limit the term or phrase it explains.

The term "porous material" refers to a material that has inter-connected porosity and/or a material that is micro-drilled. A porous material may be fabricated from metal powder particles using powder metallurgy techniques. The porous material may comprise synthetic materials, ceramics, or combinations and composites thereof. The porous material may be a sintered material or may be a micro-drilled material. The porous material may have a range of pore sizes (whether created by a sintering process or by micro-drilling) from about 0.1 micrometer to about 300 micrometers. For example, the porous material may have a pore size in the range in micrometers of about 0.1-300, 0.2-100, 5.0-50, 20-50, or any individual value or range falling in between the listed ranges. Additionally or alternatively, the pore size within a porous material may vary throughout the material or the porous material may include pores of more than one pore size within the disclosed ranges.

FIG. 1. A first rotary tool may include a rotary cylinder 110. The outer surface 118 of the rotary cylinder 110 has a plurality of dies 112 and orifices 114 arranged thereon. In the example of FIG. 1, orifices 114 are located within the confines of each die 112. As illustrated by the cross-section view provided at FIG. 1, each orifice 114 extends from the inner surface 116 of the rotary cylinder to the outer surface 118 of the rotary cylinder 110. The rotary cylinder 110 defines an internal chamber 120. The rotary cylinder 110 is assembled with and around a shaft 122 extending axially through the internal chamber 120.

The shaft 122 has a channel 124 seated therein. FIG. 1 shows a vertical cross section of the channel 124. The channel 124 is more clearly illustrated in FIG. 3. The channel 124 is in fluid communication with a plurality of outlets 126 which exit on the surface of the shaft 122. Air flowing through the channel 124 may be directed out of the shaft 122 and into the internal chamber 120, which may represent the internal volume of the rotary cylinder 110.

Figure 2:
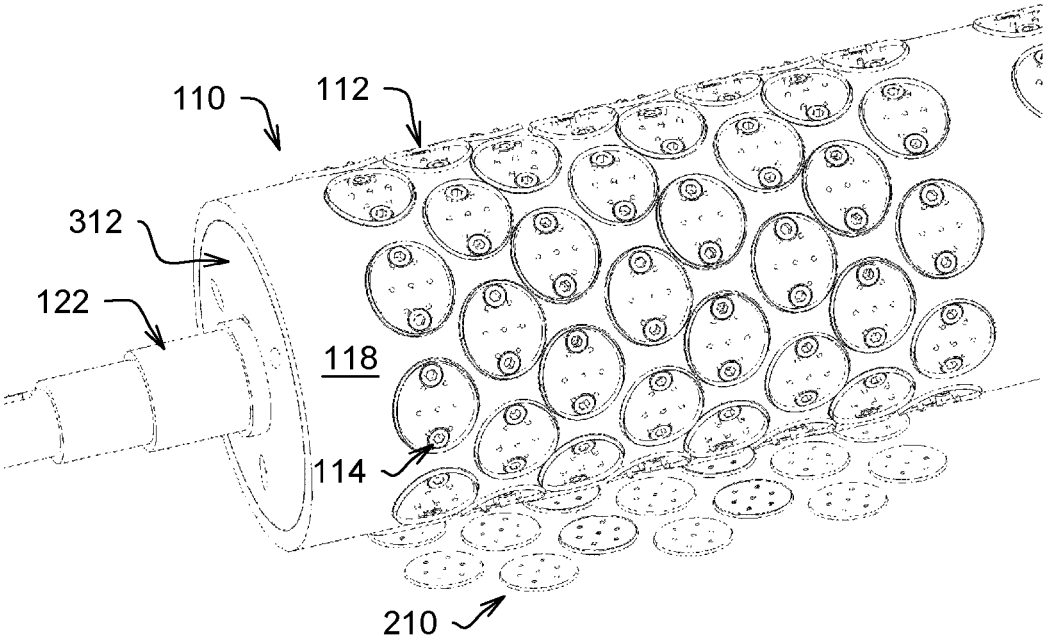
FIG. 2 provides a partial perspective view of a first rotary tool ejecting a product.

Turning to FIG. 2, in basic operation, pressurized air is supplied to a channel 124 seated within the shaft 122 of a rotary cylinder 110. Air escapes the channel 124 through outlets 126. The pressurized air enters the internal chamber 120. As the rotary cylinder 110 makes contact with a roll or sheet of dough, the dies 112 are filled with dough, thus blocking orifices 114. The air exiting the channel 124 through outlets 126 provides a force sufficient to act on the dough, ejecting and/or releasing the dough from the die 112. The formed product 210, which may be a formed dough, from the die 112 may be collected onto a transport belt. In a variation, the air flowing through an orifice 114 may prevent, fully or partially, dough from contacting the tool surface.

Figure 3:
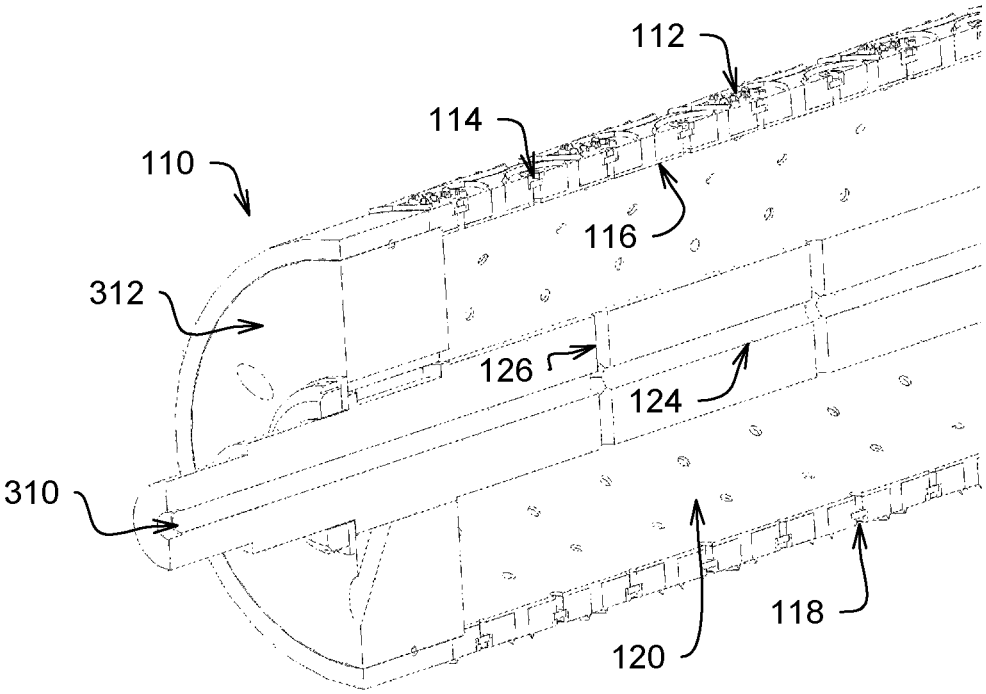
FIG. 3 provides a second partial cross section view first rotary tool.

FIG. 3 is a partial sectional view of the rotary tool 100 of FIG. 1. The rotary cylinder 110 defines an internal chamber 120. The rotary cylinder 110 is assembled with and around a shaft 122 extending axially through the internal chamber 120. The shaft 122 has a channel 124 seated therein. In a variation, the channel 124 may extend to opposite ends of the shaft 122. The channel 124 may extend within the shaft 122 beyond the respective ends of the rotary cylinder 110. The shaft 122 may permit mounting of the air manifold and the rotary cylinder 110 on a press. The rotary cylinder 110 may be rotatable relative to the shaft 122 containing the air manifold and/or the rotary cylinder 110 and the shaft 122 may rotate in conjunction. The shaft 122 may have an inlet 310 adapted for connection to a source of pressurized air.

The channel 124 is in fluid communication with a plurality of outlets 126 which exit on the surface of the shaft 122. The outlets 126 may extend generally radially outward from the channel 124, (which may be a longitudinal channel) to locations on the outer surface of the shaft 122. Air flowing through the channel 124 may be directed out of the shaft 122 and into the internal chamber 120, which may represent the internal volume of the rotary cylinder 110. The shaft 122, an end hub 312 and the rotary cylinder 110 may be in a sealed arrangement, creating a sealed internal chamber 120. The sealed arrangement may permit air flow only through the orifices 114.

Figure 4:
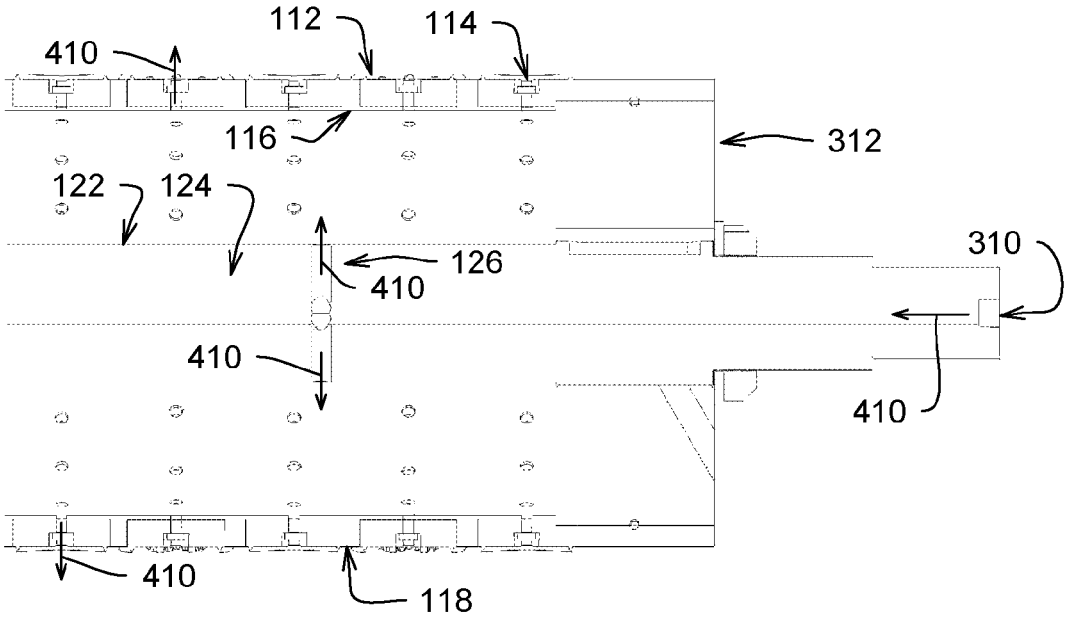
FIG. 4 provides a partial cross section view of a first rotary tool demonstrating an air flow variation.

FIG. 4 provides an air flow diagram. Air, represented by the arrow designated as 410, may enter an inlet 310 portion of the shaft 122. The air 410 may flow down the shaft to the outlets 126. Air 410 may accumulate in the internal chamber 120 and exit through orifices 114. If dough is absent from the dies 112, air 410 will flow simultaneously through all orifices 114. If dough is present in the dies 112, pressure will increase in the die 112, e.g., behind the dough. The air 410 emitted from the orifice 114 will generate a force on the dough present in the dies 112 sufficient to eject the dough from the die 112. In a variation, the air 410 emitted from the orifice 114 will generate a force on the dough present in the dies 112 sufficient to release the dough from the die 112. In one example, air 410 flowing through the orifice 114 into the die 112 may prevent, fully or partially, dough from contacting the outer surface 118, which may thereby create a release of dough from the outer surface 118 of the cylinder 110.

The example of FIG. 1 through FIG. 4 permit all orifice 114 locations to be active simultaneously while the rotary tool 100 operating. Each die 112 may include at least a single orifice 114, however, as demonstrated, each die 112 may include two or more orifice 114. Where two or more orifices 114 are located within one die 114, there may be increased air volume at low velocity. Air 410 passing from the internal chamber 120 simultaneously through all orifices 114 may provide air 410 to the material in the die 112 that is of a low pressure and air volume. It has been observed by our internal testing that good ejection performance may be achieved at a pressure of at least about 1 psi supplied at a volume of at least about 0.01 to about 1.00 SCFM. In an example, we have demonstrated that the performance parameters for a rotary tool with 144 dies 112 and 288 orifices 114 may be achieved with an air compressor of 10HP providing 70 SCFRM of compressed air at 90 PSI.

Air 410 supplied through the channel 124 and exiting through outlets 126 into the internal chamber 120 may expand. The internal volume of air in the internal chamber 120 may remain at a pressure greater than ambient pressure.

Figure 5A:
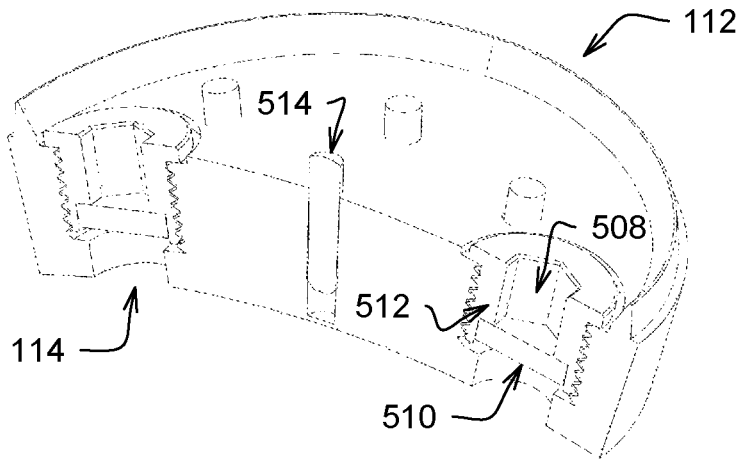
FIG. 5A provides a cross section of a die.

FIG. 5A provides a view of a single die 112. In this example, the die 112 is in a cutter formation. A cross section view through the orifice 114 shows that the orifice 114 may be assembled with a porous material 510. The porous material 510 may be seated in the orifice 114 such that air 410 flowing from the internal chamber 120 passes through the porous material 510 before reaching the contents of the die 112.

There are multiple manners of integrating the porous material 510 into the orifice 114. These have been illustrated in commonly owned patent application Ser. Nos. 14/810,612; 14/810,833; and 14/850,839, each of which are incorporated herein in their entirety. In this example, the porous material 510 is provided in a disk formation. The porous material 510 is assembled with an insert housing 512. The insert housing 512 provides a carrier for the porous material 510.

The porous material 510 may have the advantage of preventing the content, e.g., a dough product from being caught or trapped in the orifice 114. In a variation that uses an insert housing 512 inserted into the orifice 114, the porous material 510 may prevent the content from being caught or trapped in the insert housing 512. The porous material 510 may permit air to flow from the internal chamber 120 through the porous material 510 assembled into the orifice 114, providing an ejection force on any dough material present in the die 112 (which may be a mold and/or cutter). Alternatively or additionally, the porous material 510 may permit air to flow from the internal chamber 120 through the porous material 510 assembled into the orifice 114, preventing or reducing dough sticking to the die 112 (which may be a mold and/or cutter). The porous material 510 may have the additional or alternative property of prohibiting the flow of content (e.g., dough, cookie dough, cracker dough, candy paste, and other food material) back into the porous material 510, the insert housing 512, internal chamber 120 and/or orifice 114. The porous material 510 may additionally or alternatively vent the die 112, which may improve product fidelity by relieving entrapped air from the cavity. Entrapped air may prevent good packing. Good packing of dough into the cavity improves product quality and shape.

The die 112 may include one or more docker pins 514. The docker pins 514 may also be of a variety and description described in more detail in commonly owned patent application Ser. Nos. 14/810,612 and 14/810,833, incorporated herein. Docker pins 514 may have functions including but not limited to piercing dough for air release, promoting free release of a cut or molded product, and/or retention of a molded product.

Figure 5B:
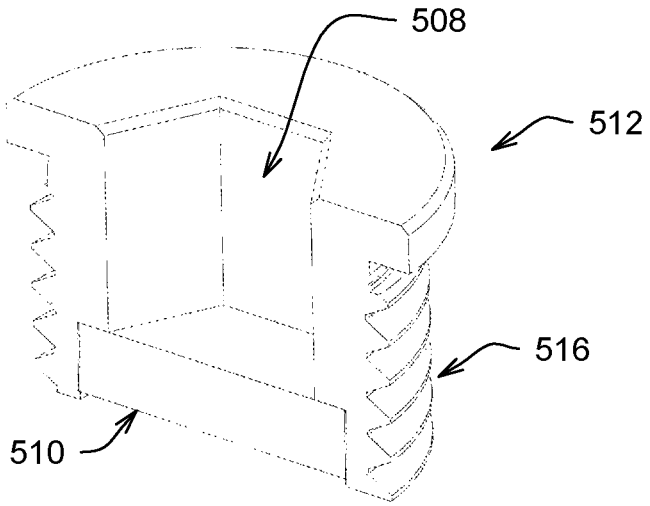
FIG. 5B provides a cross section of an insert housing.

Turning to FIG. 5B, the insert housing 512 may define a central opening 508, which central opening 508 shall be in communication with orifice 114 (e.g., the central opening 508 may be a continuation of the orifice 114). In a variation, where an insert housing 512 is to be used, the orifice 114 may be machined to accommodate the insert housing 512 such that the central opening 508 of the insert housing 512 may be aligned with the orifice 114. The central opening 508 may be hexagonal (as shown) or any other shape. In a variation, the shape of the central opening 508 may facilitate interaction with a tool, such as a hex key (in this example) or similar tool configurations known. The insert housing 512 may have an external thread allowing the insert housing 512 to interact with the orifice 114 in a threaded fashion. This may combination of the hexagonal shape and thread may provide quick assembly and disassembly for cleaning or replacement. In a variation, the porous material 510 may comprise a 316 stainless steel with a porosity of approximately 5 micron to 30 micron. The porous material 510 may be provided as a disk of material that has an exemplary diameter of 0.10 inches to 0.50 inches and a thickness of about 0.020 inch to about 0.200 inch.

Figure 6A:
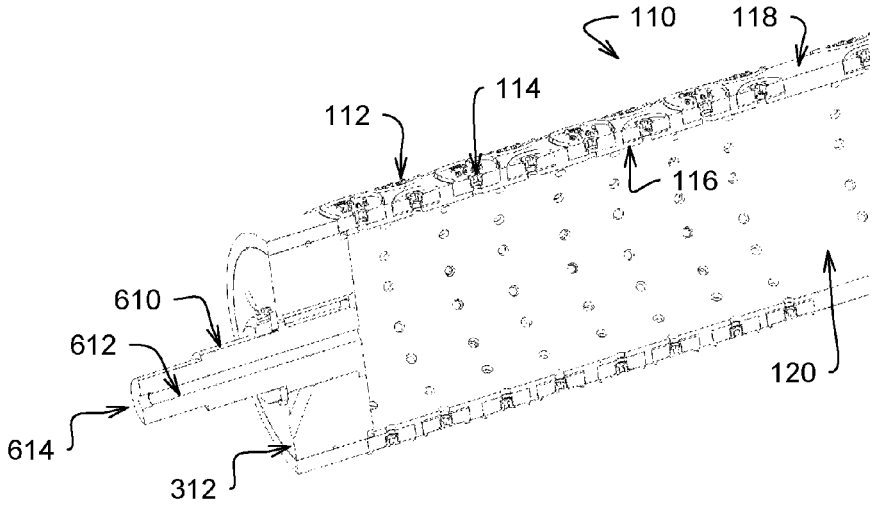
FIG. 6A provides a partial cross section of a variation of a rotary tool.

FIG. 6A provides a cross section view of a variation of a rotary tool. This variation demonstrates that air may be supplied to the internal chamber 120 of a rotary cylinder 110 without the use of a shaft 122. In this variation, a rotary cylinder 110 has a plurality of dies 112 and orifices 114 arranged thereon. Orifices 114 may be located within the confines of each die 112. Each orifice 114 extends from the inner surface 116 of the rotary cylinder to the outer surface 118 of the rotary cylinder 110. The rotary cylinder 110 defines an internal chamber 120. The rotary cylinder 110 is assembled with an end hub 312. The rotary cylinder 110 with an end hub 312 at each end may be in a sealed arrangement, creating the sealed internal chamber 120.

The end hub 312 may be assembled with stub shafts 610. The stub shaft 610 may have a stub shaft channel 612 seated therein. The stub shaft channel 612 is in fluid communication with internal chamber 120. The stub shaft 610 may have a stub shaft inlet 614 adapted for connection to a source of pressurized air. Air flowing through the stub shaft channel 612 may be directed out of the stub shaft 610 and into the internal chamber 120, which may represent the internal volume of the rotary cylinder 110. The stub shaft 610 is just one manner of delivering pressurized air to the internal volume 120 of the rotary cylinder 110.

Figure 6B:
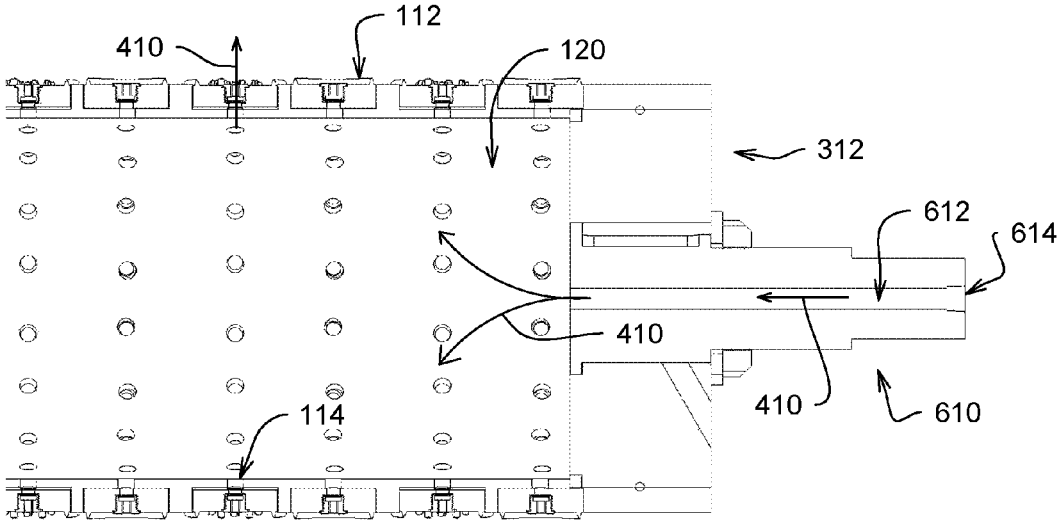
FIG. 6B provides a partial cross section view of a variation a rotary tool demonstrating an air flow variation.

Turning to FIG. 6B, in basic operation, pressurized air is supplied to a stub shaft channel 612 seated within the stub shaft 610 of a rotary cylinder 110. Air escapes the stub shaft channel 612 and enters the internal chamber 120. As the rotary cylinder 110 makes contact with a roll or sheet of dough, the dies 112 are filled with dough, thus blocking orifices 114. Air from the internal chamber 120 exits the orifice 114. The air exiting the orifice 114 provides a force sufficient to act on any material in the die 112, ejecting the material from the die 112 and/or facilitating the release of material from the die 112. The formed product 210 released from the die 112 may be collected onto a transport belt.

FIG. 6B provides an air flow diagram. Air, represented by the arrow designated as 410, may enter a stub shaft inlet 614 portion of the stub shaft 610. The air 410 may flow down the stub shaft channel 612 and may accumulate in the internal chamber 120 and exit through orifices 114. If dough is absent from the dies 112, air 410 will flow simultaneously through all orifices 114. If dough is present in the dies 112, pressure will increase in the die 112, e.g., behind the dough. The air 410 emitted from the orifice 114 will generate a force on the dough present in the dies 112 sufficient to eject the dough from the die 112. Alternatively or additionally, the air 410 emitted from the orifice 114 may partially or fully prevent dough from adhering to the die 112 sufficient to result in easy release of the product 210 from the die 112.

Figure 7:
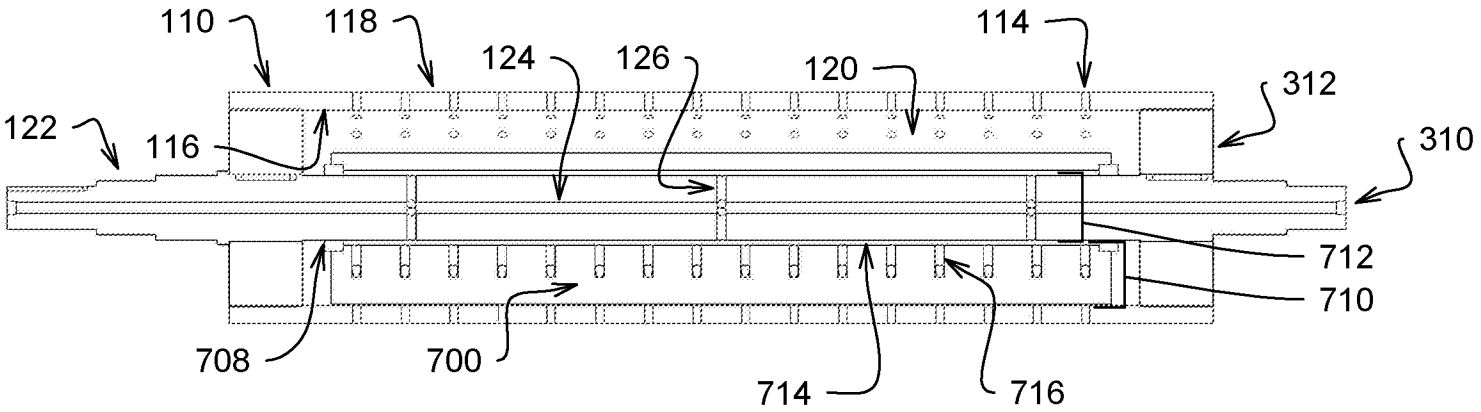
FIG. 7 provides a cross section of a rotary tool with manifold.

FIG. 7 provides a full sectional view of a second variation of a rotary tool. The rotary tool may include a rotary cylinder 110. The outer surface of the rotary cylinder 110 has a plurality of orifices 114 arranged thereon. Dies FIG. 1, 112 are not included on this generic rotary tool. As discussed above, the shape and implementation of dies 112 varies widely. The disclosure has applicability to any of the various die 112 known, and/or disclosed in the patent applications integrated by reference. Orifices 114 may be located within the confines of any die 112 implemented hereon. As illustrated by the cross-section view provided at FIG. 7, each orifice 114 extends from the inner surface 116 of the rotary cylinder to the outer surface 118 of the rotary cylinder 110. The rotary cylinder 110 defines an internal chamber 120. The rotary cylinder 110 is assembled with and around a shaft 122 extending axially through the internal chamber 120. The shaft 122 has a channel 124 seated therein. The channel 124 is in fluid communication with a plurality of outlets 126 which exit on the surface of the shaft 122. The spacing and number of orifices 114 will be determined by the specific implementation.

A manifold 700 may be assembled with the shaft 122. The manifold 700 may be suspended from the shaft 122 and supported by bearings 708. The manifold 700 may include an internal bore 712. The internal bore 712 may be adapted to assemble with the shaft, e.g., adapted for assembly around the shaft 122. The region of the manifold below the internal bore 712 may be referred to as the ejection body 710. The ejection body 710 may be a region of the manifold 700 that directs ejection air to a portion of the rotary cylinder 110.

The internal bore 712 of the manifold 700 may be assembled around the shaft 122 such that the internal bore 712 has a concentric relationship to the shaft 122. The ejection body 710 may have a gravitational arrangement with the shaft 122. A gravitational arrangement may be created where the ejection body 710 is suspended vertically below the shaft 122 and maintained in a fixed position, e.g., by gravitational force. The shaft 122 and rotary cylinder 110 may rotate freely while the ejection body 710 remains suspended in its gravitational arrangement below the shaft 122.

The internal bore 712 and thus the manifold 700 may be spaced from the shaft 122 by the bearings 708. Mounting of the bearings 708 from the shaft 122 may create an air passage 714 between the manifold 700 and the shaft 122. The air passage 714 may receive air from the outlets 126 on the shaft 122. The air passage 714 may supply air to conduits 716. The conduits 716 may be positioned for intermittent alignment with each of the orifices 114 in the rotary cylinder 110 as the rotary cylinder 110 rotates relative to the manifold 700. The manifold 700 may be in sealed arrangement with the shaft 122 such that air entering the manifold 700 from the outlets 126 on the shaft 122 does not substantially enter the internal chamber 120 of the rotary cylinder 110.

Figure 8:
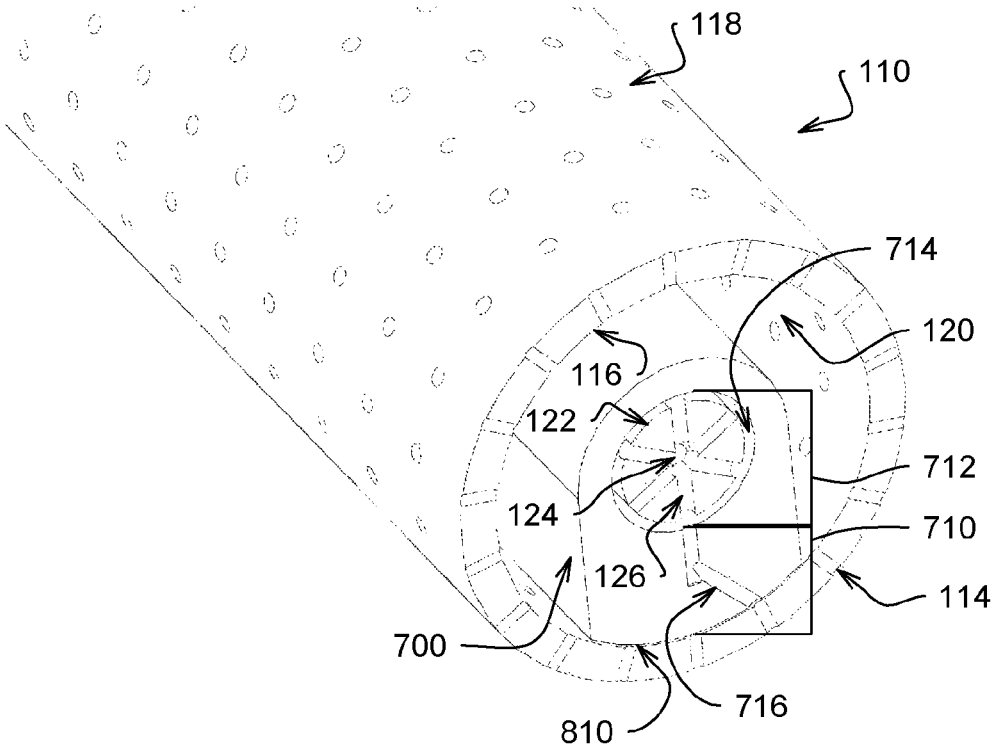
FIG. 8 provides a second cross section of a rotary tool with manifold.

FIG. 8 provides a perspective view through a vertical plane of the rotary tool. The manifold 700 may be in sealed arrangement with the shaft 122 such that air entering the manifold 700 from the outlets 126 on the shaft 122 does not enter the internal chamber 120 of the rotary cylinder 110. The displacement of the manifold 700 from the shaft 122 may create an air passage 714 between the manifold 700 and the shaft 122. The air passage 714 may receive air from the outlets 126 on the shaft 122. The air passage 714 may supply air to conduits 716. The conduits 716 may be positioned for intermittent alignment with each of the orifices 114 in the rotary cylinder 110 as the rotary cylinder 110 rotates relative to the manifold 700. The conduits 716 may be positioned to deliver intermittent bursts of air, which may be pressurized air, through the orifices 114 in the rotary cylinder 110. The bursts of air may serve to eject any material located over the orifices 114 (e.g., dough material located within dies FIG. 1, 112).

The manifold 700 may hang freely in the internal chamber 120, and may be dimensioned within the internal chamber 120 such that, when hanging from the shaft 122, a precision gap 810 exists between a bottom most portion of the manifold 700 and the inner surface 116 of the rotary cylinder 110. In an exemplary variation, the precision gap 810 may be an about 0.001 to about 0.015 inch space between the bottom most portion of the manifold 700 and the inner surface 116 of the rotary cylinder 110. The precision gap 810 may restrict air flow into the internal chamber 120 of the rotary cylinder 110. For example, the precision gap 810 may substantially reduce or eliminate air leakage from the manifold 700 to the inner chamber 120 of the rotary cylinder 110.

Figure 9:
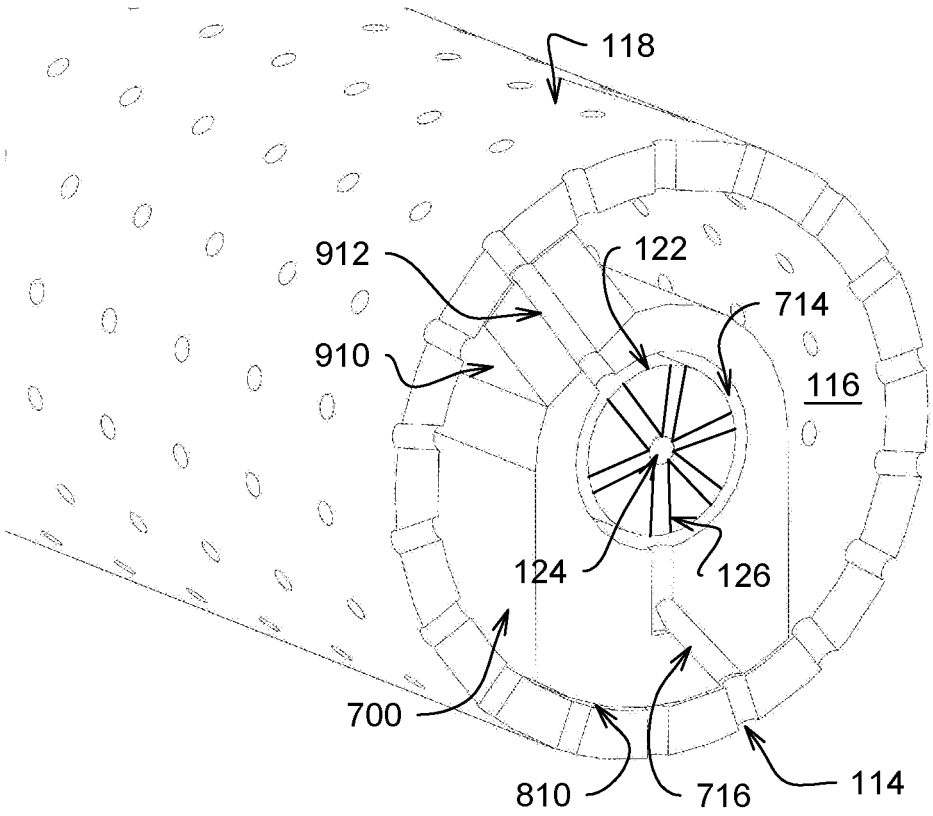
FIG. 9 provides a cross section of a rotary tool with manifold with an ejection bar.

FIG. 9 provides a multi-ejection variation. The manifold 700 ejection capacity may be increased by supplemental conduits 912. Supplemental conduits 912 may be housed in an ejection bar 910. One ejection bar 910 is shown. However, the location and number of ejection bars 910 may vary. An ejection bar 910 may be attached to a manifold 700 and may establish an additional ejection location. In this variation, the manifold 700, including any ejection bar 910 may be in sealed arrangement with the shaft 122 such that air entering the manifold 700, and any ejection bar 910 from the outlets 126 on the shaft 122 does not enter the internal chamber 120 of the rotary cylinder 110. The air passage 714 may receive air from the outlets 126 on the shaft 122. The air passage 714 may supply air to conduit 716 and supplemental conduit 912. Conduit 716 and/or supplemental conduit 912 may be positioned for intermittent alignment with orifices 114 in the rotary cylinder 110 as the rotary cylinder 110 rotates relative to the manifold 700. The conduit 716 and supplemental conduit 912 may be positioned to deliver intermittent bursts of air, which may be pressurized air, through the orifices 114 in the rotary cylinder 110. The bursts of air may serve to eject any material located over the orifices 114 (e.g., dough material located within dies FIG. 1, 112).

Conduit 716 and supplemental conduit 912 may supply conduits at disparate locations on the rotary cylinder 110. Where the conduit 716 and supplemental conduit 912 supply different locations, they may also provide different functions. In an example, rotary cylinders including dies 112 in the cutter formation operate by cutting product from a sheet of dough. The dough that remains after product is removed from the sheet of dough is commonly referred to as webbing. Webbing represents scrap material. The orifices 114 receiving air from conduits 716 and/or supplemental conduits 912 may be arranged relative to the dies 112 (e.g., outside of the dies 112 versus inside of the dies 112 or otherwise) such that air ejection may be used to assist scrap removal from the rotary cylinder 110. A multi-ejection system may permit tailored air flow, e.g., a system that permits air flow to effect ejection of product at one location while ejecting scrap at a second, disparate location.

Figure 10:
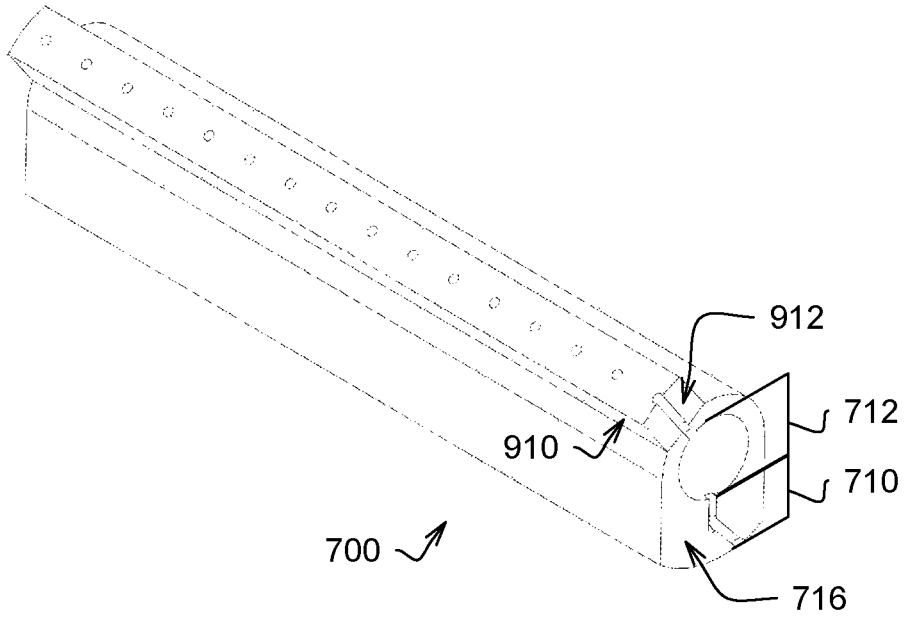
FIG. 10 provides a view of a manifold with an ejection bar.

FIG. 10 shows an isolated exemplary manifold 700 assembled with an ejection bar 910. It can be seen how the manifold 700 provides an internal bore 712 therethrough for receiving a shaft 122. The elegant design of the manifold 700 allows for efficient assembly and disassembly. This may permit, e.g., easy wash down and maintenance of the manifold 700 and the rotary cylinder 110. The manifold 700 may be removed and washed. Alternatively or additionally, a wash fluid or steam may be passed through the manifold 700, e.g., through the air passage 714, conduit 716 and supplemental conduit 912.

While variations of the invention have been described, it will be apparent to those of skill in the art that many more implementations are possible that are within the scope of the claims.

The invention claimed is:

1. A rotary tool comprising:

a rotary cylinder;

the rotary cylinder having an outer surface and defining an internal chamber;

a plurality of dies on the outer surface of the rotary cylinder;

orifices defined through the rotary cylinder from the outer surface of the rotary cylinder to the internal chamber;

the orifices in fluid communication with the internal chamber;

each orifice assembled with a porous material;

a shaft extending through the internal chamber;

the shaft having a channel seated therein;

outlets in the shaft extending generally radially outward from the channel to locations on the outer surface of the shaft;

a manifold;

the manifold comprising an ejection body and a bore;

the bore adapted for concentric arrangement with the shaft;

the manifold displaced off of the shaft by a bearing, creating an air passage between the manifold and the shaft;

the ejection body comprising a conduit;

the conduit positioned for intermittent alignment with the orifices in the rotary cylinder as the rotary cylinder rotates relative to the manifold.

2. The rotary tool of claim 1, the dies are mold cavity dies.

3. The rotary tool of claim 1, the dies are cutter dies.

4. The rotary tool of claim 1, further comprising:

the ejection body positioned below the shaft.

5. The rotary tool of claim 1, wherein the shaft and the rotary cylinder capable of rotating relative to a fixed manifold.

6. The rotary tool of claim 1, the manifold assembled with an ejection bar.

7. The rotary tool of claim 6, the ejection bar comprising supplemental conduits.

8. The rotary tool of claim 7, the supplemental conduit positioned for intermittent alignment with orifices.

9. A rotary tool comprising:

a rotary cylinder;

the rotary cylinder having an outer surface and defining an internal chamber;

a plurality of dies on the outer surface of the rotary cylinder;

orifices defined through the rotary cylinder from the outer surface of the rotary cylinder to the internal chamber;

the orifices in fluid communication with the internal chamber;

each orifice assembled with a porous material;

a shaft extending through the internal chamber;

the shaft having a channel seated therein;

outlets in the shaft extending generally radially outward from the channel to locations on the outer surface of the shaft;

a manifold;

the manifold comprising an ejection body and a bore;

the bore adapted for concentric arrangement with the shaft;

the manifold displaced off of the shaft by a bearing, creating an air passage between the manifold and the shaft;

the ejection body comprising a conduit in fluid communication with the air passage;

the conduit positioned for intermittent alignment with the orifices in the rotary cylinder as the rotary cylinder rotates relative to the manifold;

the manifold assembled with an ejection bar;

the ejection bar comprising supplemental conduits; and the supplemental conduit positioned for intermittent alignment with orifices.

10. The rotary tool of claim 9, the dies are mold cavity dies.

11. The rotary tool of claim 9, the dies are cutter dies.

12. The rotary tool of claim 9, further comprising:

the ejection body positioned below the shaft.

13. The rotary tool of claim 12, wherein the shaft and the rotary cylinder capable of rotating relative to a fixed manifold.

* * * * *